United States Patent [19]

Meisner

[11] Patent Number: 4,517,892

[45] Date of Patent: May 21, 1985

[54] UNIVERSAL CAN CRUSHER

[76] Inventor: Donald D. Meisner, 2420 S. M St., Oxnard, Calif. 93033

[21] Appl. No.: 325,723

[22] Filed: Nov. 30, 1981

[51] Int. Cl.[3] ..... B30B 9/32

[52] U.S. Cl. ..... 100/292; 100/266; 100/293; 100/295; 100/902

[58] Field of Search ..... 100/902, 293, 266, 292, 100/295; 99/583; 248/215

[56] References Cited

U.S. PATENT DOCUMENTS

| | | | |
|---|---|---|---|
| 2,246,394 | 6/1941 | Steele | 100/902 X |
| 2,373,057 | 4/1945 | Shinn | 100/292 X |
| 2,622,316 | 12/1952 | Borland | 100/902 X |
| 3,536,287 | 10/1970 | Kramer | 248/215 X |
| 3,766,849 | 10/1973 | Maron | 100/902 X |
| 3,780,647 | 12/1973 | Reimers | 100/902 X |
| 3,980,015 | 9/1976 | Woodard | 100/902 X |
| 4,058,054 | 11/1977 | Markman | 100/902 X |
| 4,143,595 | 3/1979 | Carlson | 100/902 X |
| 4,213,387 | 7/1980 | McCaney | 100/902 X |
| 4,323,009 | 4/1982 | Voigt | 100/902 X |

FOREIGN PATENT DOCUMENTS

| | | | |
|---|---|---|---|
| 594831 | 6/1959 | Italy | 100/292 |

*Primary Examiner*—Billy J. Wilhite

*Attorney, Agent, or Firm*—David O'Reilly

[57] ABSTRACT

A portable can crushing device particularly suitable for crushing aluminum cans. The can crushing device is comprised of a housing having a carriage with an abutment movable towards a fixed abutment supported by the housing. The carriage is mounted for horizontal movement in slots in the housing and is moved toward the abutment by means of an eccentric cam, which has a curvature such that maximum force is applied to the can during the first few inches of travel, then a lesser force at higher speed is applied to complete the crushing of the can. The cam is provided by the edge of a rotably mounted plate engaging a roller on the carriage with the plate having a handle or lever for rotating the cam and applying the force. Aluminum cans placed between the carriage and end wall are crushed by rotating the handle up to apply a force through the cam to the carriage to crush the cans down to approximately less than one-fifth (1/5) their full size.

13 Claims, 4 Drawing Figures

UNIVERSAL CAN CRUSHER

BACKGROUND OF THE INVENTION

This invention relates generally to compacting devices and more particularly relates to a compacting device suitable for crushing and salvaging aluminum cans.

With every increasing costs all metals are becoming more costly to recovery from refinement of natural resources. Thus, recycling of metals is becoming more and more a method of reducing the costs of these metals. The metals are recycled by collecting discarded devices from which the metals are made and then melting down and reusing the metal to make new devices.

In particular, aluminum from natural resources is becoming more and more scarce and the price is rising. Thus, the recycling of aluminum and specifically aluminum cans has become more attractive for the production of aluminum used in new devices. These cans however, in the uncrushed state take up a great deal of space and can make collecting, shipping and recycling an expensive procedure. Usually, the cans are crushed by some means such as use of the foot to flatten them so that they will take up much less space. However, crushing them in this manner is unsatisfactory as it is time consuming and dangerous.

Devices for crushing cans are known, but generally they are bulky, heavy or inefficient in operation. A disadvantage of the known type of can crushers is that they must be fastened to some solid surface in order to function. This means they are generally not sufficiently portable for use at any location where discarded aluminum cans may be found. Additionally, these devices are not suitable for use by everyone as they generally are designed for use by persons who have a great deal of strength. It would be advantageous if a portable can crushing device could be designed that was efficient enough in operation that it did not require great strength for use.

SUMMARY OF THE INVENTION

The purpose of the present invention is to provide a device for crushing aluminum cans which is portable and is simple and easy to operate.

The can crushing device of the present invention is comprised of a housing having a horizonally movable carriage movable towards an abutment supported by the housing. The carriage is moved by an eccentric cam, which applied maximum force through the first few inches of travel with a lesser force being applied during the remaining crushing force applied to a can.

The eccentric cam is rotably mounted for rotation by a lever and engages a roller or wheel attached to the carriage for moving the carriage toward the abutment. The carriage is mounted in horizontal slots in the housing, and has a pair of plates coming together to form a dihedrial which tends to keep the can centered in the device during the crushing process. The fixed abutment supported by the housing is mounted at a slight downward angle to be certain a can being crushed does not pop out of the device. The length of movement of the carriage is sufficient to allow the can crusher to be used with the large or the small aluminum cans.

It is one object of the present invention to provide an aluminum can crushing device which is simple and easy to operate and is portable.

Another object of the present invention is to provide a can crushing device which applies a greater force during the first few inches of travel to break down an aluminum can.

Still another object of the present invention is to provide a can crushing device which has construction to allow rapid travel after the aluminum can has been broken down by the increased force in the first few inches.

Still another object of the present invention is to provide a can crushing device having means for keeping the can in place and centered during the crushing procedure.

These and other advantages, objects and novel features of the invention become apparent from the following detailed description when considered in conjunction with the accompanying drawings.

DESCRIPTION OF THE PREFERRED EMBODIMENT

Figure 1:
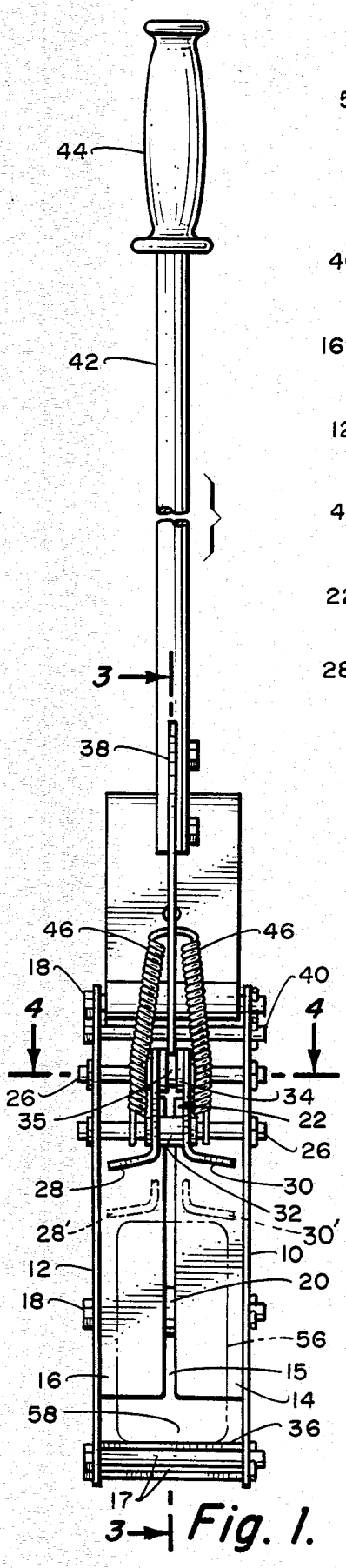
FIG. 1 is a top view of a can crushing device according to the invention.

The can crushing device according to the invention is illustrated in the FIG. 1 and has a housing comprised of side plates 10 and 12, bottom plates 14 and 16, which are joined together by means of bolts 18 passing through spacers or bushings 20. A carriage 22 is movable mounted in the housing and supported in slots 24 in each of the side plates 10, 12 by means of bolts 26 passing through the carriage and engaging the respective slots in the side plates. A movable abutment is formed by plates 28 and 30 secured on the bolts 26 and separated by a spacer 32 at one end and a roller or wheel 34 at the other. The abutment formed by the plates 28 and 30 lie in a dihedrial plane which tends to provide a centering force on a can placed in the crusher.

Figure 3:
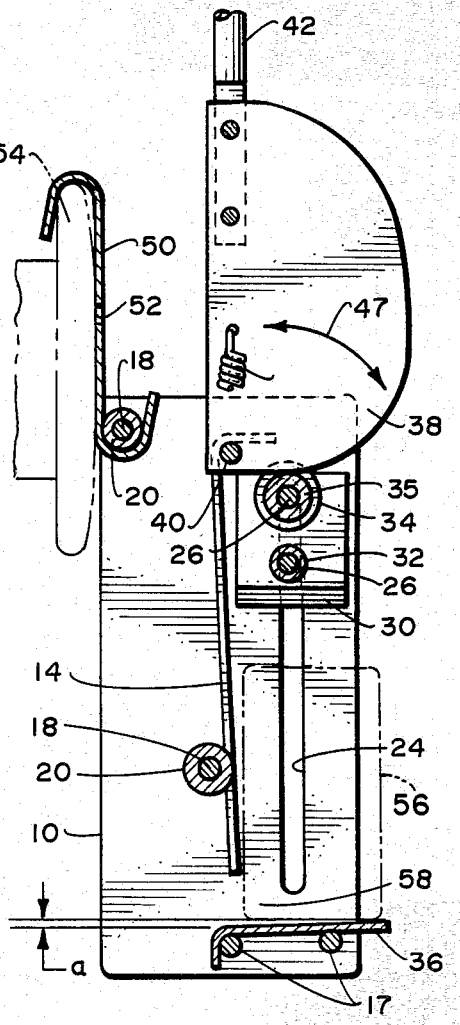
FIG. 3 is a sectional view taken at 3:3 of FIG. 1.

A second abutment is formed by the end plate 36 secured to the housing by the bolts 17 clamping the end plate 36 between the side plates 10, 12 as shown in FIG. 3. A unique feature of the end plate 36 is its slight backward tilt at an angle indicated at "a" of up to ten (10) degrees, but preferrably is approximately about five (5) degrees. The slight tilt assures containment of the can in the housing during the crushing operation. It was discovered that this slight tilt prevents any cans from "popping" out of the housing when force is applied to the end of the can.

The force is applied to the carriage 22 by means of an eccentric cam formed on the edge of a plate rotably mounted on a bolt 40. A handle 42 having a strip 44 is attached to the plate for increased leverage when applying a force to the carriage 22. Springs 46 join the cam plate 38 to the carriage 22 by hooking over the bolt 26. Thus, the carriage 22 will move back and forth and remain in engagement with the eccentric edge of the cam plate 32.

Figure 4:
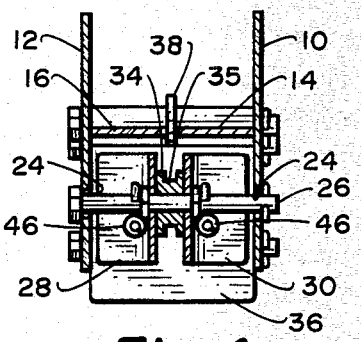
FIG. 4 is a sectional view taken at 4:4 of FIG. 1.

The cam plate 38 engages the groove 35 in the roller or wheel 34 mounted on the bolt 26. Thus, as the cam plate is rotated as indicated at 47 in FIG. 3 the carriage 22 moves toward the abutment formed by the end plate 36. Conversely, the springs cause the carriage 22 to move backward with rotation of the handle and cam plate 38 maintaining contact at the edge of the cam plate in the channel or groove 35 of roller 34. The cam plate 38 can freely rotate and passes through the slot or gap 15 between the bottom plates 14 and 16 in the housing as illustrated in FIG. 4.

The can crushing device according to the invention is light enough and compact enough to be easily carried around and may be portable. Additionally, the device includes a hanger 50 which maybe mounted to a surface by means of the hole 52 or maybe in the shape of an S-hook as shown in the sectional view of FIG. 3 for hooking over a rail or a bumper illustrated in phantom at 54. One end of the S shape of the hanger 50 engages the bushing or shim 20 on the bolt 18 with the other end passing over the upper edge of a support such as bumper 54.

Figure 2:
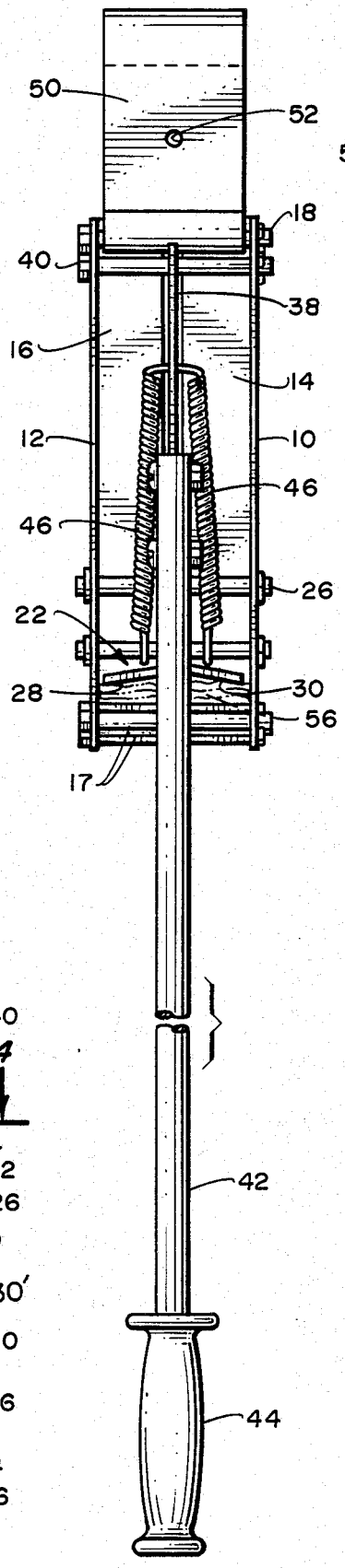
FIG. 2 is also a top view of the can crushing device according to the invention illustrating its operation.

The operation of the can crushing device can be seen by referring to FIGS. 1 and 2. An aluminum can illustrated in phantom at 56 is placed in the housing with one end against the abutment formed by end plate 36. The carriage 22 is then moved forward by rotating the handle 42 until the plates 28 and 30 engage the end of the can as illustrated in phantom at 28' and 30'. As was stated previously, the dihedral plane formed by the plates 28 and 30 have an included angle of approximately 170 degrees and therefore tend to center the aluminum can 56 in the crushing device.

A continuous force applied to the handle 42 causes the cam plate 36, because of its configuration, to apply a tremendous initial force to the can to overcome the moment of inertia and resistance to crushing of the can. Once this resistance is overcome the cam has a gentler and longer path of travel allowing the can to be fully crushed to the position illustrated in FIG. 2 which is somewhere in the order of less than one-fifth (1/5) of its uncrushed volume. A gap 58 provided between the end plate 36 and the bottom plates 14, 16 will allow the can 56 to drop out the bottom when the carriage is moved away. Thus, another can can be quickly inserted and crushed. In this manner the can crusher can be placed on top of some type of trash container and cans quickly crushed and automatically dropped out the bottom into the container.

The design of the cam 38 and the length of the slots 24 in the sides allow the can crusher to accommodate cans up to the half quart size easily. Further, the cam is so shaped that the handle when moved toward the carriage to begin the crushing process permits maximum force to be applied at an angle near the vertical. Thus, only a small force is needed to stabilize the can crusher while in use.

Thus, there has been described a novel, portable can crusher which is simple and easy to use. The can crusher has several unique features making the crushing of aluminum cans not only easy to do, but maintains the can in the crusher during the crushing process.

This invention is not to be limited by the embodiment shown in the drawings and described in the descriptions, which are given by way of example and not of limitation, but only in accordance with the appended claims.

What is claimed is:

1. A can crushing device comprising:

fixed abutment means;

movable abutment means mounted in opposing relationship to said fixed abutment means;

said movable abutment means comprising:

movable carriage means;

planar means mounted on said carriage means for movement therewith;

said planar means being formed to have a dihedral angle;

movable means for moving said movable abutment means toward or away from said fixed abutment means;

said movable means adapted to apply a variable force to said movable abutment means during its movement toward said fixed abutment means.

2. The device according to claim 1 wherein said movable means includes means for applying a gradually increasing force to said movable abutment means up to a maximum force and then apply a gradually decreasing force to the end of travel of said movable abutment means.

3. The device according to claim 2 wherein said means for applying a gradually increasing force to said movable abutment means applies said maximum force between the range of 20 percent to 35 percent of the travel of said movable abutment.

4. The device according to claim 3 wherein said movable means comprises;

eccentric cam means;

said eccentric cam means adapted to engage and move said movable abutment means.

5. The device according to claim 4 wherein said eccentric cam means comprises;

a pivotally mounted plate;

said eccentric cam means being formed by an eccentric curvature formed on an edge of said plate.

6. The device according to claim 5 wherein said movable carriage includes cam guide means engaging said edge of said pivotally mounted plate.

7. The device according to claim 1 wherein said fixed abutment means comprises;

a housing;

planar end plate means on said housing having side walls and a bottom plate.

8. The device according to claim 7 wherein said end plate means is at a slight angle to the vertical.

9. The device according to claim 5 wherein said slight angle is in the range of one to ten degrees.

10. The device according to claim 9 wherein said angle is five degrees.

11. The device according to claim 7 wherein said housing includes;

a gap between said planar end plate means and said bottom plate through which said cans may fall after being crushed between said movable and fixed abutment means.

12. The device according to claim 7 including portable hanger means for hanging said device on an edge.

13. The device according to claim 12 wherein said portable hanger means comprises, a cylindrical bolt traversing said housing;

an S-shaped plate adapted to hook said cylindrical bolt at one end and an edge on the other end.

* * * * *